US005350175A

United States Patent [19]

DiLullo et al.

[11] Patent Number: 5,350,175

[45] Date of Patent: Sep. 27, 1994

[54] BETTING GAME METHOD OF PLAY

[75] Inventors: Dean DiLullo, 7066 Shadow Crest, Las Vegas, Nev. 89119; James Jorasch, Los Altos Hills, Calif.

[73] Assignee: Dean DiLullo, Las Vegas, Nev.

[21] Appl. No.: 178,502

[22] Filed: Jan. 7, 1994

[51] Int. Cl.[5] ..... A63F 9/04

[52] U.S. Cl. ..... 273/146; 273/274

[58] Field of Search ..... 273/146, 274, 138 R, 273/309

[56] References Cited

U.S. PATENT DOCUMENTS

| | | | |
|---|---|---|---|
| 1,669,470 | 5/1928 | Jasper . | |
| 4,247,114 | 1/1981 | Carroll | 273/274 |
| 4,312,508 | 1/1982 | Wood | 273/274 |
| 4,334,685 | 6/1982 | Robbins et al. | 273/274 |
| 4,346,900 | 8/1982 | Lamlee | 273/274 |
| 4,635,938 | 1/1987 | Gray | 273/274 |
| 4,746,126 | 5/1988 | Angileri | 273/274 X |
| 4,902,019 | 2/1990 | Berman | 273/256 |
| 5,133,559 | 7/1992 | Page | 273/274 |
| 5,265,881 | 11/1993 | Doherty | 273/146 X |
| 5,308,081 | 5/1994 | Bartle | 273/274 |

FOREIGN PATENT DOCUMENTS

| | | | |
|---|---|---|---|
| 2063689 | 6/1981 | United Kingdom | 273/274 |

*Primary Examiner*—William E. Stoll

[57] ABSTRACT

A method of playing a betting game is disclosed. A playing surface includes numerical zones that represent the possible outcomes of the sum of either two rolls of a pair of dice or three rolls of a pair of dice. Certain of these zones are defined as walls, and the other zones are provided with payout rewards. In play, a number of players place "survival" bets. One player is selected to begin rolling the pair of dice until either the maximum number of rolls is achieved without hitting a wall, or the sum of each roll of the dice falls within a wall. If the sum of the rolls of the dice falls within a wall, the survival bets are collected, the dice are passed to another player, and the game begins again. Otherwise, the appropriate payout reward is paid to each player who made a survival bet. Other single-roll side bets may be included for allowing players to bet upon the chance outcome of high numbers, low numbers, doubled, or a natural 12. The gaming method disclosed builds excitement and anticipation with each successive roll of the dice, and as such is an unusually exciting game to play and observe.

8 Claims, 4 Drawing Sheets

Frequency Distribution
Two-Roll Embodiment

| N1+N2 | On Bets Of | Expected Frequency | Player Win/(Loss) Per Cycle | Player Win/(Loss) Cummulative |
|---|---|---|---|---|
| | | | | |
| 4 | $1 | 109 | ($1.00) | ($109.00) |
| 5 | $1 | 148 | ($1.00) | ($148.00) |
| 6 | $1 | 187 | ($1.00) | ($187.00) |
| 7 | $1 | 10 | $0.00 | $0.00 |
| 8 | $1 | 13 | $0.00 | $0.00 |
| 9 | $1 | 22 | $0.00 | $0.00 |
| 10 | $1 | 34 | $0.00 | $0.00 |
| 11 | $1 | 118 | ($1.00) | ($118.00) |
| 12 | $1 | 61 | $0.00 | $0.00 |
| 13 | $1 | 76 | $0.00 | $0.00 |
| 14 | $1 | 92 | $0.00 | $0.00 |
| 15 | $1 | 96 | $0.00 | $0.00 |
| 16 | $1 | 91 | $1.00 | $91.00 |
| 17 | $1 | 80 | $1.00 | $80.00 |
| 18 | $1 | 63 | $1.00 | $63.00 |
| 19 | $1 | 46 | $1.00 | $46.00 |
| 20 | $1 | 27 | $2.00 | $54.00 |
| 21 | $1 | 14 | $3.00 | $42.00 |
| 22 | $1 | 6 | $4.00 | $24.00 |
| 23 | $1 | 2 | $5.00 | $10.00 |
| 24 | $1 | 1 | $100.00 | $100.00 |
| | | | | |
| **Total** | | **1,296** | | **($52.00)** |
| **House Advantage** | | | | **4.01%** |

Assumptions:
Average Bet = $1.00
Single-roll side bets not included in calculations

FIG 3

Frequency Distribution
Three-Roll Embodiment

| N1+N2+N3 | On Bets Of | Expected Frequency | Player Win/(Loss) Per Cycle | Player Win/(Loss) Cummulative |
|---|---|---|---|---|
| | | | | |
| 6 | $1 | 1 | $100.00 | $100.00 |
| 7 | $1 | 6 | $10.00 | $60.00 |
| 8 | $1 | 21 | $5.00 | $105.00 |
| 9 | $1 | 56 | $2.00 | $112.00 |
| 10 | $1 | 6894 | ($1.00) | ($6,894.00) |
| 11 | $1 | 6588 | ($1.00) | ($6,588.00) |
| 12 | $1 | 376 | $0.00 | $0.00 |
| 13 | $1 | 492 | $0.00 | $0.00 |
| 14 | $1 | 710 | $0.00 | $0.00 |
| 15 | $1 | 1020 | $0.00 | $0.00 |
| 16 | $1 | 1393 | $0.00 | $0.00 |
| 17 | $1 | 1776 | $0.00 | $0.00 |
| 18 | $1 | 2262 | $0.00 | $0.00 |
| 19 | $1 | 2828 | $0.00 | $0.00 |
| 20 | $1 | 3213 | $0.00 | $0.00 |
| 21 | $1 | 3676 | ($1.00) | ($3,676.00) |
| 22 | $1 | 3458 | ($1.00) | ($3,458.00) |
| 23 | $1 | 3196 | ($1.00) | ($3,196.00) |
| 24 | $1 | 2694 | $0.00 | $0.00 |
| 25 | $1 | 2112 | $1.00 | $2,112.00 |
| 26 | $1 | 1547 | $2.00 | $3,094.00 |
| 27 | $1 | 1046 | $3.00 | $3,138.00 |
| 28 | $1 | 642 | $4.00 | $2,568.00 |
| 29 | $1 | 360 | $5.00 | $1,800.00 |
| 30 | $1 | 180 | $6.00 | $1,080.00 |
| 31 | $1 | 76 | $7.00 | $532.00 |
| 32 | $1 | 23 | $8.00 | $184.00 |
| 33 | $1 | 4 | $9.00 | $36.00 |
| 34 | $1 | 3 | $10.00 | $30.00 |
| 35 | $1 | 2 | $500.00 | $1,000.00 |
| 36 | $1 | 1 | $5,000.00 | $5,000.00 |
| | | | | |
| **Total** | | **46,656** | | **($2,861.00)** |
| **House Advantage** | | | | **6.13%** |

Assumptions:
Average Bet = $1.00
Single-roll side bets not included in calculations

FIG 4

BETTING GAME METHOD OF PLAY

FIELD OF THE INVENTION

This invention relates generally to betting games, and, more particularly, is directed towards a betting game determined by the sum of up to a predetermined number of consecutive rolls of a pair of dice.

BACKGROUND OF THE INVENTION

Games of chance, and particularly betting games, must have certain attributes to make them attractive to players. Ideally, such games should have reasonable odds only slightly in favor of the house or bank. Further, such games should. be easy to learn, understand, and play. Such games should also be exciting for all of those playing, and ideally pit each player against the house as opposed to against each other. Games with a large potential jackpot or top payout are certainly more exciting than those with a relatively small maximum payout.

Clearly, however, such games of chance must also have certain attributes to make them attractive to the house. Such games must have a suitable house advantage, and preferably a relatively small cycle time between rounds of betting so that more rounds of the game can be played in any given period of time. Such games must be easy to administrate, learn, and play. Further, such games should attract a large number of players per table, and allow for excitement to build as a player does progressively better. The equipment for such games must be easy to maintain and is preferably inexpensive to manufacture.

The most popular casino betting games have all of these attributes to varying degrees. For example, blackjack, or 21, is a game that can attract up to seven players per table, is relatively simple to administrate, utilizes an inexpensive deck of cards and a screenprinted felt tabletop that is easy to maintain or replace, and provides relatively quick cycle time between rounds of betting. The house advantage for blackjack varies with the strategy used by each player, but is always slightly in favor of the house. However, the maximum payout on any particular original bet of $1 is only $1.50, or 1.5 to 1. As such, only so much excitement can be generated by blackjack, and one usually does not observe large excited crowds huddled around the blackjack table.

Considering roulette, the maximum payout is 35 to 1, which is over twenty times that of blackjack and therefore more exciting to many people. However, the roulette wheel itself is relatively expensive to purchase and maintain, typically $6,000, and the average cycle time per round is relatively high. Further, roulette only builds excitement for a short time, that is, when the ball is just about to land in the roulette wheel.

Craps is a game that can generate a tremendous amount of excitement among the players and nearby observers. Such excitement is due, in part, to the fact that other players are betting on the chance outcome of a pair of dice thrown by another of the players. As such, there tends to be a higher degree of supportive vocalization from the players not throwing the dice. Sometimes loud commotion from the players often results in the craps tables being jammed to capacity. Further, the rules in craps allow for the excitement to build as the player continues to roll the dice. On the downside, craps is a fairly difficult game to learn, understand, and play, and as a result is not appreciated by many gamblers. Further, the maximum payouts for craps are not nearly as high as, for example, roulette.

Several dice games are taught in the prior art. For example, U.S. Pat. No. 4,312,508 to Wood on Jan. 26, 1982 teaches a die game that is administered by a dealer and allows for a number of players simultaneously. Other dice games are taught in U.S. Pat. No. 4,635,938 to Gray on Jan. 13, 1987; U.S. Pat. No. 5,133,559 to Page on Jul. 28, 1992; and U.S. Pat. No. 4,247,114 to Carroll on Jan. 27, 1981. While such prior art games have several of the advantages listed above, none have all of the advantages.

Clearly, then, there is a need for a dice game that allows for a continual building of excitement from the players and attracts a large number of players and observers. Such a needed game would have reasonable odds, and would be easy to learn, understand, and play. Such a needed game would also be exciting for all of those playing, and would pit each player against the house as opposed to against each other. Such a game would have a relatively large potential top payout for added excitement. Preferably, such a game would have a relatively small cycle time between rounds so that more rounds of the game can be played in any given period of time. The game would be easy to administrate and require relatively few decisions on the part of the player. Further, the equipment for such a game must be easy to maintain and is preferably inexpensive to manufacture. The present invention fulfills these needs and provides further related advantages.

SUMMARY OF THE INVENTION

The present invention is a method for playing a betting game that employs a pair of conventional six-sided dice. In a first embodiment, the game is played by rolling the pair of dice such that any one of the numbers 2 through 12 can result as the sum of the numbers on both dice. The number produced by the first roll is represented by N1. On a second roll of the dice, a second number N2 can result, and the sum of N1 and N2 will be a number 4 through 24.

The game is played by first providing a playing surface with numerical zones representing the numbers 2 through 24, and betting zones for players to place betting tokens or currency. A subset of the numerical zones is defined as the "wall," and preferably includes the numbers 4, 5, 6, and 11. Rewards are set for the numerical zones not in the wall. A croupier, or dealer, typically administrates the game and represents the "bank" or the "house."

Play begins by having players place bets in a "survival" betting zone or "line." One of the players is selected to roll the pair of dice to determine the first outcome number N1. If the player "hits the wall," that is, if number N1 is in the wall, the bets are collected from the survival zone, by the croupier, the dice are give to a next player, and the game starts over with bets being placed again. If, on the other hand, the number N1 is not within the wall, the player rolls the dice again to determine the second outcome number N2. As before, if the number N1 plus N2 is in the wall, the bets are collected from the survival bet zone, the dice are given to the next player, and the game starts over with bets being placed again. If, however, the number N1 plus N2 is not in the wall, the reward indicated for the numerical zone representing the number N1 plus N2 is paid to all players who have placed bets in the survival bet zone.

In an alternate embodiment of the game, the dice are rolled as many as three times, and the "wall" is defined as the numbers 10, 11, 21, 22, and 23. As such, a third number N3 can result from the third roll of the dice, and the sum of the numbers N1, N2, and N3 will result in a number 6 through 36. On the third roll of the dice, as before, if the number N1 plus N2 plus N3 is in the wall, the bets are collected from the survival bet zone, the dice are given to the next player, and the game starts over with bets being placed again. If, however, the number N1 plus N2 plus N3 is not in the wall, the reward indicated for the numerical zone representing the number N1 plus N2 plus N3 is paid to all players who have placed bets in the survival bet zone.

Preferably, several additional single-roll side betting zones may be included for allowing players to bet for either a high number resulting in the next roll of the dice, a low number resulting in the next roll of the dice, a "hard" or doubles roll of the dice, that is, both dice resulting in the same number, or a natural 12 or "double sixes" roll of the dice.

The present invention is a betting game that allows for a continual building of excitement from the players by utilizing the cumulative total of successive rolls of a pair of dice. The present game tends to attract a large number of players and observers, and has odds which can be easily modified as appropriate. Further, the game is easy to learn, understand, and play. The present game is exciting for all of those playing, and pits each player against the house as opposed to against each other. The method of the present invention allows for a relatively large potential top payout for added excitement, while still providing for a slight house advantage. The present invention further results in a relatively small cycle time between rounds so that more rounds of the game can be played in any given period of time. The game is easy to administrate and requires relatively few decisions on the part of the player. Further, the equipment of the present invention is easy to maintain and is relatively inexpensive to manufacture. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 3 is a table showing the frequency distribution of the preferred rewards for the numerical zones in the "two roll" embodiment of the invention; and FIG. 4 is a table showing the frequency distribution of the preferred rewards for the numerical zones in the "three roll" embodiment of the invention.

DETAILED DESCRIPTION OF THE PREFERRED EMBODIMENTS

Figure 1:
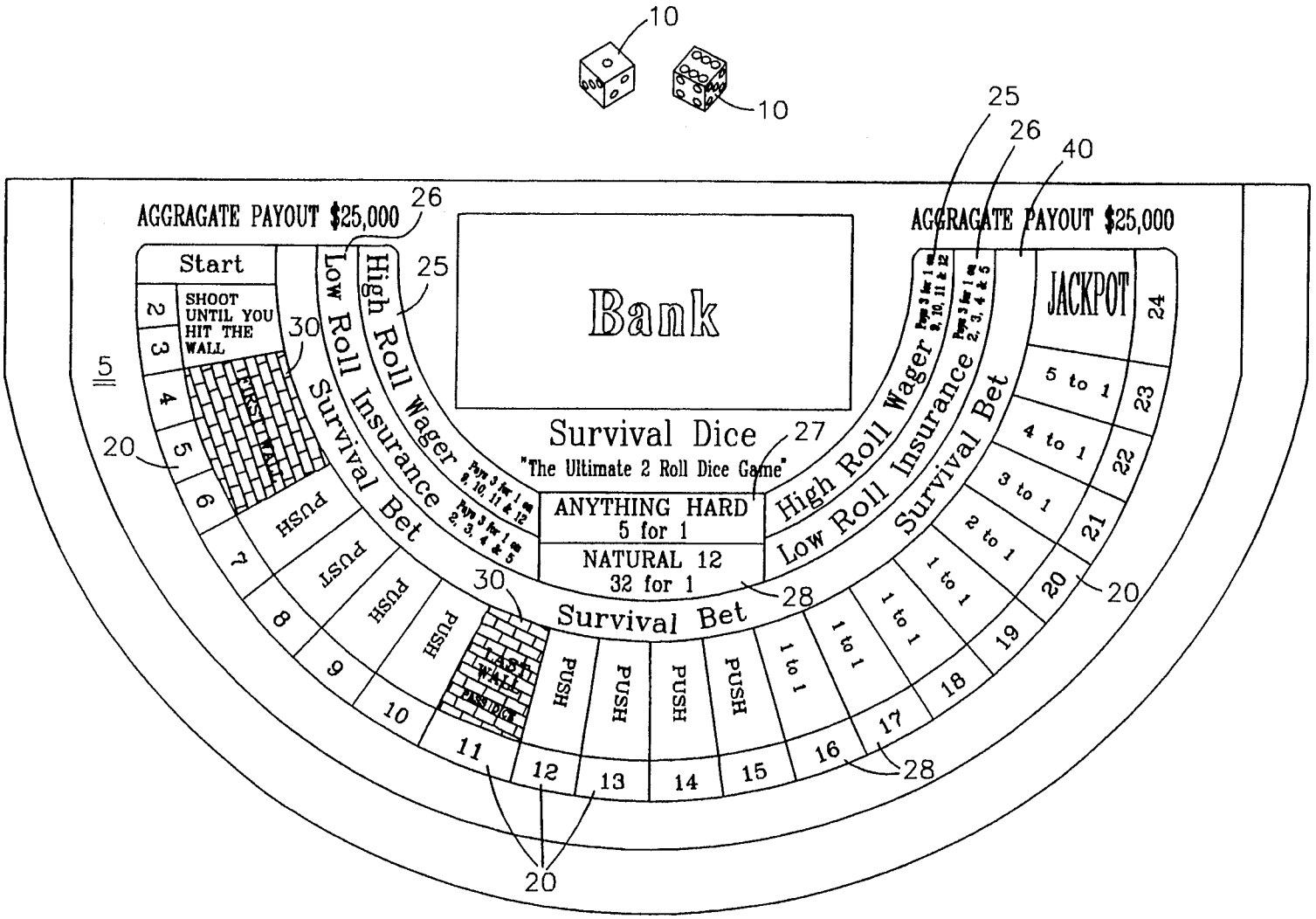
FIG. 1 is a top plan view of a playing surface of the invention, illustrating a "two roll" embodiment of the invention.

FIG. 1 shows a playing surface 5 for a betting game that employs a pair of conventional six-sided dice 10 or their mechanized equivalent. In the first embodiment, the game is played by rolling the pair of dice 10 such that any one of the numbers 2 through 12, defining a first numerical set S1, can result as the sum of the numbers on each die 10. The number produced by the first roll is represented by N1. On a second roll of the dice 10, a second number N2 can result from the set S1, and the sum of N1 and N2 will be a number 4 through 24, which defines a second numerical set S2.

The game is played by first providing the playing surface 5 with numerical zones 20 representing the union of sets S1 and S2. A subset SS3 of S2 is defined as the "wall" 30, and is preferably the numbers 4, 5, 6, and 11. For clarity, a first portion of the "wall" may be referred to as the "first wall" defined as the consecutive numbers 4, 5, and 6, and a second portion may be referred to as the "second wall" representing the number 11. Rewards are set for the numerical zones 20 representing the numbers in S2 but not in SS3. A croupier typically administrates the game and represents the "bank" or the "house," and he accepts bets placed in a survival bet zone 40.

One of the players placing bets is selected to roll the pair of dice 10 to determine the first outcome number N1. If the number N1 is in SS3, that is, if the player "hits the wall" 30, all bets are collected from the survival zone 40 by the croupier, the dice 10 are give to a next player, and the game starts over with bets being placed again. If, on the other hand, the number N1 is not within SS3, the player rolls the dice 10 again to determine the second outcome number N2. As before, if the number N1 plus N2 is in SS3, the bets are collected from the survival bet zone 40 by the croupier, the dice 10 are given to the next player, and the game starts over with bets being placed again. If, however, the number N1 plus N2 is not in SS3, the reward indicated for the numerical zone 20 representing the number N1 plus N2 is paid to all players who have placed bets in the survival bet zone 40. Preferably such rewards for any particular numerical zone 20 range from "1 to 1," or a "push," to "100 to 1," that is, rewards from even money to one-hundred times one's bet, depending upon the odds that N1 plus N2 will fall within the particular numerical zone 20. FIG. 3 is a table that lists the frequency distribution of the preferred rewards for the numerical zones 20. Clearly, other reward values may be assigned to each numerical zone 20 by those skilled in the art such that the house advantage is arbitrarily set. An aggregate payout limit for the entire table for any one round of betting may also be included.

Figure 2:
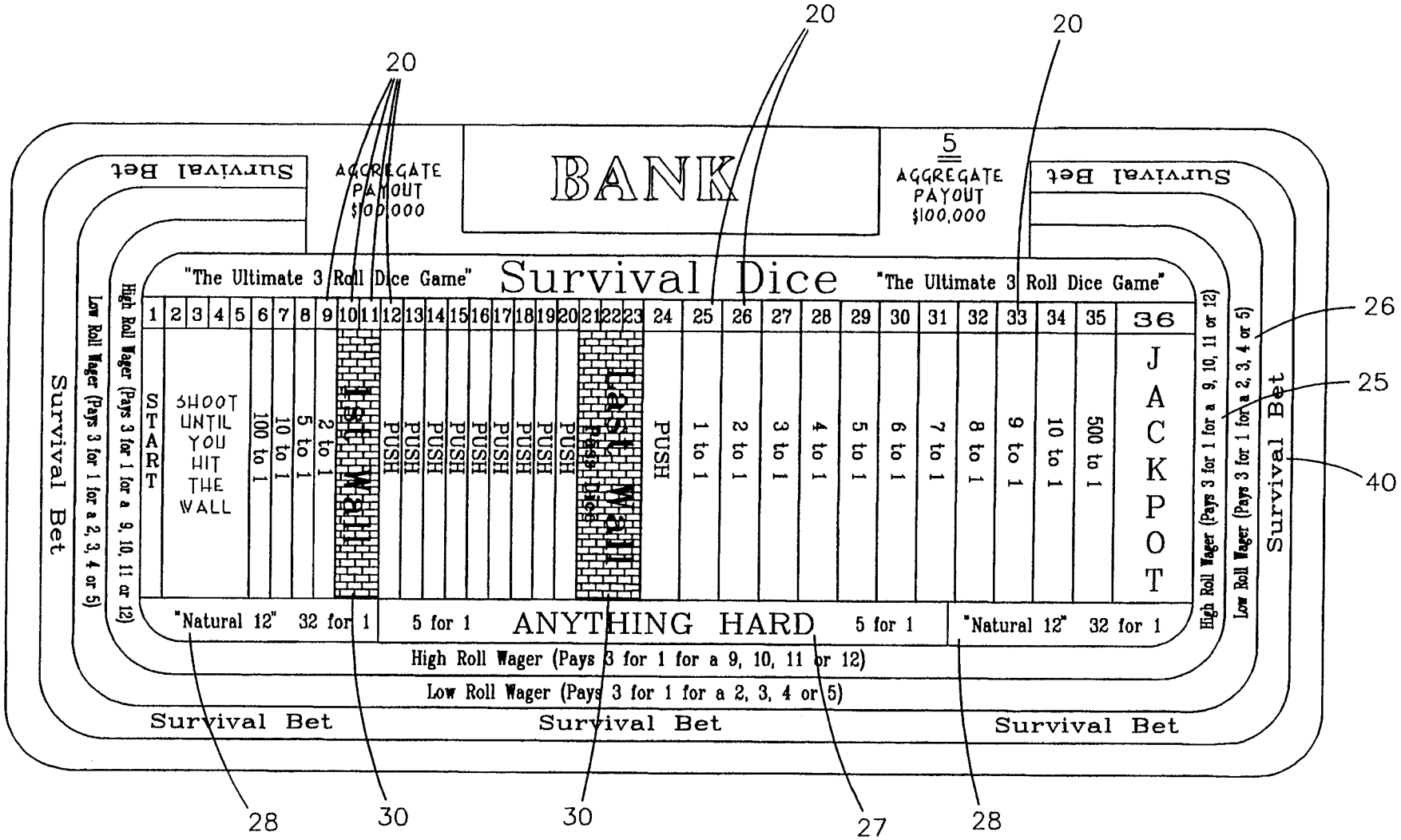
FIG. 2 is a top plan view of a playing surface of the invention, illustrating a "three roll" embodiment of the invention.

The "three roll" embodiment of the game shown in FIG. 2 is played in like manner as that of FIG. 1, except that the dice 10 are rolled as many as three times. As such, a third number N3 can result from the set S1, and the sum of the numbers N1, N2, and N3 will result in a number 6 through 36, which defines a third numerical set S3. On the third roll of the dice 10, as before, if the number N1 plus N2 plus N3 is in SS3, all bets are collected from the survival bet zone 40 by the croupier, the dice 10 are given to the next player, and the game starts over with bets being placed again. If, however, the number N1 plus N2 plus N3 is not in SS3, the reward indicated for the numerical zone 20 representing the number N1 plus N2 plus N3 is paid to all players who have placed bets in the survival bet zone 40. In such an embodiment, SS3 preferably comprises the numbers 10, 11, 21, 22, and 23. Further, the rewards for any particular numerical zone 20 preferably range from "1 to 1," or "push," to "5,000 to 1," that is, rewards from even money to five-thousand times one's bet, depending upon the odds that N1 plus N2 plus N3 will fall within the particular numerical zone 20. FIG. 4 is a table that lists the frequency distribution and the preferred rewards for each numerical zones 20. Clearly, other reward values may be assigned to each numerical zone 20 by those skilled in the art. An aggregate payout limit may be included for the entire table for any one round of betting. Further, a progressive jackpot may be included such that the payout for N3 being the number 36, instead of being a fixed reward, is variable and depends upon the number of bets made on a group of tables over a period of time, with the jackpot over time becoming progressively larger until someone wins it.

A high roll zone 25 may be further included as a side bet for rewarding on a single roll of the dice 10 any winning number N1, N2, or N3 within a previously selected first subset SS1 of any of the first numerical set S1. In embodiments of the game employing the high roll zone 25, when a bet is placed in the high roll zone 25, if the resulting outcome number on the next roll of the dice is within the first subset SS1, the indicated reward is paid to the player betting in the high roll zone 25. Otherwise, the bet in the high roll zone 25 is collected by the croupier. Preferably, for both embodiments of the invention, the first subset SS1 includes the numbers 9, 10, 11 and 12.

Similarly, a low roll zone 26 may be further included as a side bet for rewarding on a single roll of the dice 10 any winning number N1, N2, or N3 within a previously selected second subset SS2 of any of the first numerical set S1. In embodiments of the game employing the low roll zone 26, when a bet is placed in the low roll zone 26, if the resulting outcome number on the next roll of the dice is within the second subset SS2, the indicated reward is paid to the player betting in the low roll zone 26. Otherwise, the bet in the low roll zone 26 is collected by the croupier. Preferably, the second subset SS2 includes the numbers 2, 3, 4, and 5.

Similarly, an "anything hard" zone 27 may be further included as a side bet for rewarding on a single roll of the dice 10 any winning number N1, N2, or N3 within a previously selected fourth subset SS4 of any of the first numerical set S1. In embodiments of the game employing the anything hard zone 27, when a bet is placed in the anything hard zone 27, if the resulting outcome number on the next roll of the dice is within the fourth subset SS4, the indicated reward is paid to the player betting in the anything hard zone 27. Otherwise, the bet in the anything hard zone 27 is collected by the croupier. Preferably, the fourth subset SS4 includes the numbers 2, 4, 6, 8, 10, and 12, with both die 10 showing the same number, that is, a "doubles" roll of the dice 10.

Similarly, a "natural 12" zone 28 may be further included as a side bet for rewarding on a single roll of the dice 10 any winning number N1, N2, or N3 that is a previously selected single one of any of the first numerical set S1, preferably 12, or "double sixes." In embodiments of the game employing the "natural 12" zone 28, when a bet is placed in the "natural 12" zone 28, if the resulting outcome number on the next roll of the dice is a 12, the indicated reward is paid to the player betting in the "natural 12" zone 28. Otherwise, the bet in the "natural 12" zone 28 is collected by the croupier.

In play, a number of people place bets in any of the zones 40, 25, 26, 27, or 28. A player is selected by the croupier to begin throwing the pair of dice 10. On the first roll of the dice 10, the number N1 within the set S1 results. The croupier determines if any of the bets within the zones 25, 26, 27, and 28 are winners, in which case the croupier pays the winning bets in accordance to the rewards previously set for each zone 25, 26, 27, and 28, accordingly. Those bets within zones 25, 26, 27, and 28 that are not winners are collected by the croupier. Further, if the number N1 is within the set SS3, all of the bets in the survival zone 40 are collected by the croupier. After the first roll of the dice 10, bets on the survival zone 40 are closed. However, the croupier may still accept bets on the single-roll betting zones 25, 26, 27, and 28 before each roll of the dice 10.

If the number N1 is not within the set SS3, the player again rolls the dice 10. The resulting number N2 of the second roll of dice is added to the first number N1, and if the result is within the set SS3, the croupier collects the bets previously placed within the survival zone 40. As before, any bets within zones 25, 26, 27, and 28 are paid or collected as appropriate. In the embodiment where the game is played with as many as two rolls (FIG. 1), if the result of N1 plus N2 is not within the set SS3, rewards are paid for bets placed within the survival zone 40 as determined by the previously set reward for the numerical zone represented by N1 plus N2. In the embodiment where the game is played with as many as three rolls (FIG. 2), if the result of N1 plus N2 is not within the set SS3, the dice 10 are rolled a third and final time to obtain N3. If the result of N1 plus N2 plus N3 is not with the set SS3, rewards are paid for bets placed within the survival zone 40 as determined by the previously set reward for the numerical zone represented by N1 plus N2 plus N3. Otherwise, if N1 plus N2 plus N3 is within the set SS3, all the bets placed on the survival zone 40 are collected by the croupier. In one embodiment of the invention, the dice 10 are passed to the next player only if the "second wall" is hit. Otherwise, the same player continues to roll the dice 10.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A method for playing a betting game employing a pair of dice or their mechanized equivalent, such that any one of the numbers from 2 through 12, defining a first numerical set S1, can result from a fair roll of the dice, the number produced being an outcome represented by N1, and any one of the numbers between 4 and 24, defining a second numerical set S2, can result from summing the outcomes, N1 plus N2; of two sequential fair rolls of the dice, the method comprising the steps of:

a) setting rewards on a single roll of the dice wherein a winning number may be any member of a previously selected first subset SS1, of the first numerical set S1;

b) setting rewards on a single roll of the dice wherein a winning number may be any member of a previously selected second subset SS2, of the first numerical set S1, wherein SS1 and SS2 are mutually exclusive;

c) setting rewards on a single roll of the dice wherein a winning number may be any one of the even numbers of S1, the winner being chosen only if the dice are thrown as doubles;

d) setting rewards on a single roll of the dice wherein a single member of S1 is selected as the winning number;

e) setting rewards on two rolls of the dice wherein a winning bet may be any member of S2 exclusive of a previously selected subset SS3, of S2;

f) taking bets on the members of S1 for rewards determined in accordance with steps (a) through (d) for a single roll of the dice;

g) taking bets on the members of S2 for rewards determined in accordance with step (e);

h) rolling the dice to determine a first outcome number N1;

i) rewarding successful bets in accordance with steps (a) through (d), and collecting bets placed in accordance with step (e) when N1 is a member of SS3;

j) rolling the dice to determine a second outcome number N2;

k) rewarding, in accordance with step (e), when the sum of N1 plus N2 is not equal to a member of SS3, and collecting all remaining bets when the sum of N1 plus N2 equals any member of SS3.

2. A method for playing a betting game employing a pair of dice or their mechanized equivalent, such that any one of the numbers from 2 through 12, defining a first numerical set S1, can result from a fair roll of the dice, the number produced being an outcome represented by N1, and any one of the numbers between 6 and 36, defining a second numerical set S2, can result from summing the outcomes, N1 plus N2 plus N3, of three sequential fair rolls of the dice, the method comprising the steps of:

a) setting rewards on a single roll of the dice wherein a winning number may be any member of a previously selected first subset SS1, of the first numerical set S1;

b) setting rewards on a single roll of the dice wherein a winning number may be any member of a previously selected second subset SS2, of the first numerical set S1, wherein SS1 and SS2 are mutually exclusive;

c) setting rewards on a single roll of the dice wherein a winning number may be any one of the even numbers of S1, the winner being chosen only if the dice are thrown as doubles;

d) setting rewards on a single roll of the dice wherein a single member of S1 is selected as the winning number;

e) setting rewards on three rolls of the dice wherein a winning bet may be any member of S2 exclusive of a previously selected subset SS3, of S2;

f) taking bets on the members of S1 for rewards determined in accordance with steps (a) through (d) for a single roll of the dice;

g) taking bets on the members of S2 for rewards determined in accordance with step (e);

h) rolling the dice to determine a first outcome number N1;

i) rewarding successful bets in accordance with steps (a) through (d), and collecting bets placed in accordance with step (e) when N1 is a member of SS3;

j) rolling the dice to determine a second outcome number N2;

k) collecting all remaining bets when N1 plus N2 equals any member of SS3.

l) rolling the dice to determine a third outcome number N3;

m) rewarding, in accordance with step (e), when the sum of N1 plus N2 plus N3 is not equal to a member of SS3, and collecting all remaining bets when the sum of N1 plus N2 plus N3 equals any member of SS3.

3. A method for playing a betting game employing a pair of dice or their mechanized equivalent, such that any one of the numbers from 2 through 12, defining a first numerical set S1, can result from a fair roll of the dice, the number produced being an outcome represented by N1, and any one of the numbers between 4 and 24, defining a second numerical set S2, can result from summing the outcomes, N1 plus N2, of two sequential fair rolls of the dice, the method comprising the steps of:

a) setting rewards on a single roll of the dice wherein at least one winning number is selected from the set S1:

b) setting rewards on two rolls of the dice wherein a winning bet may be any member of S2 exclusive of a previously selected subset SS3, of S2;

c) taking bets on the members of S1 for rewards determined in accordance with step (a) for a single roll of the dice;

d) taking bets on the members of S2 for rewards determined in accordance with step (b);

e) rolling the dice to determine a first outcome number N1;

f) rewarding successful bets in accordance with step (a), and collecting bets placed in accordance with step (b) when N1 is a member of SS3;

g) rolling the dice to determine a second outcome number N2;

h) rewarding, in accordance with step (b), when the sum of N1 plus N2 is not equal to a member of SS3, and collecting all remaining bets when the sum of N1 plus N2 equals any member of SS3.

4. The method for playing a betting game of claim 3 wherein a winning number for a single roll of the dice may be any member of a previously selected first subset SS1, of the first numerical set S1.

5. The method for playing a betting game of claim 4 wherein a winning number for a single roll of the dice may be any member of a previously selected second subset SS2, of the first numerical set S1, wherein SS1 and SS2 are mutually exclusive.

6. The method for playing a betting game of claim 3 wherein a winning number for a single roll of the dice may be any one of the even numbers of S1, the winner being chosen only if the dice are thrown as doubles.

7. The method for playing a betting game of claim 3 wherein a winning number for a single roll of the dice is a selected single member of S1.

8. The method for playing a betting game of claim 7 wherein a winning number for a single roll of the dice is the number 12.

* * * * *